United States Patent [19]

Heyman

[11] 4,446,362

[45] May 1, 1984

[54] WORKPIECE WITH ABRADED MACHINE-READABLE MARKING THEREIN AND METHOD OF MAKING

[75] Inventor: Philip M. Heyman, Robbinsville, N.J.

[73] Assignee: RCA Corporation, New York, N.Y.

[21] Appl. No.: 41,092

[22] Filed: May 21, 1979

[51] Int. Cl.[3] ..... G06K 7/10

[52] U.S. Cl. ..... 235/462; 235/487; 235/495

[58] Field of Search ..... 235/376, 487, 464, 473, 235/462, 463, 495; 51/165.71, 326, 181 R, 292, 291, 72 R, 83 R, 281 R, 283 R, 439; 250/223 B; 346/21, 139 R

[56] References Cited

U.S. PATENT DOCUMENTS

| | | | |
|---|---|---|---|
| 3,702,585 | 11/1972 | Landis et al. | 101/1 |
| 3,726,212 | 4/1973 | Combs | 101/21 |
| 3,736,406 | 5/1973 | Vossen et al. | 219/216 |
| 3,792,238 | 2/1974 | Samoel | 235/473 |
| 3,820,456 | 6/1974 | Wolfheimer | 101/93 |
| 3,839,644 | 10/1974 | Fulton | 307/117 |
| 3,903,526 | 9/1975 | Cotter | 346/21 |
| 4,010,355 | 3/1977 | Roehrman et al. | 235/462 |
| 4,012,716 | 3/1977 | Herrin | 235/463 |
| 4,095,095 | 6/1978 | Muraoka et al. | 235/487 |
| 4,166,574 | 9/1979 | Yokoyama | 235/487 |

FOREIGN PATENT DOCUMENTS

| | | |
|---|---|---|
| 983296 | 2/1965 | United Kingdom . |
| 1038868 | 8/1966 | United Kingdom . |
| 1131271 | 10/1968 | United Kingdom . |
| 1238323 | 7/1971 | United Kingdom . |
| 1355732 | 6/1974 | United Kingdom . |

*Primary Examiner*—Harold I. Pitts

*Attorney, Agent, or Firm*—E. M. Whitacre; D. H. Irlbeck; L. Greenspan

[57] ABSTRACT

A workpiece having a machine-readable coded marking abraded into the surface thereof. The marking comprises a plurality of related marks, such as bar-code marking, which have substantially different light reflectances than the surrounding surface. The markings may be made by moving a means for abrading a defined surface area along a particular path with respect to the surface to be marked. The abrading means is selectively activated or deactivated according to a prearranged program to selectively abrade the surface.

5 Claims, 6 Drawing Figures

WORKPIECE WITH ABRADED MACHINE-READABLE MARKING THEREIN AND METHOD OF MAKING

BACKGROUND OF THE INVENTION

This invention relates to a novel workpiece having a machine-readable marking abraded into a surface thereof and to a novel method for producing such markings in the workpiece.

As an aid to manufacturing operations, it may be desirable to provide a unique marking on each workpiece that is processed. Such a marking can be used as part of the control system in automated manufacturing processes, Also, such a marking can be used for the computerized accumulation of historical data about the workpiece, which may later be used for quality control and for warranty purposes.

Such markings have been suggested before, but none have had all of the characteristics that are desirable, and which, in the present competitive marketplace, are necessary, for practical commercial use. Such markings, for example, must be capable of being produced by machine on each workpiece on demand at low cost, and also must be machine-readable with high reliability also at low cost. Because the workpiece is still in process, the marking must be resistant to degradation when exposed to temperatures up to at least 450° C. and to chemical attack during the processing of the workpiece. Also, the marking must be capable of being produced on flat or nonflat surfaces.

Some prior systems of marking, usually implemented by applying labels to finished articles, employed a bar-code. A bar-code marking, which is machine readable, comprises a related sequence of substantially parallel bars of predetermined widths and spacings. Bar-code markings can be printed before demand or on demand with commercially-available printers, and the markings can be read with commercially-available readers. However, using labels with bar-coded markings on in-process workpieces has been found to be unsatisfactory, particularly on glass workpieces. Not only may the marking be degraded by the processing of the workpiece, but also the label itself and the substance used to attach the label to the workpiece may be degraded by the processing of the workpiece.

SUMMARY OF THE INVENTION

The invention includes a novel workpiece, which may be of glass, having a machine-readable coded marking abraded into a surface thereof. The marking comprises a plurality of related marks, such as a bar-code marking, which have substantially different light reflectances than the surrounding surface. Such abraded marking satisfies all the above-mentioned desired characteristics of low cost and high reliability. It has substantially the same resistance to thermal and chemical treatments as the workpiece itself.

The invention includes also a novel method for producing a machine-readable marking in a surface of a rigid workpiece. The novel method comprises (a) providing means for abrading a defined area of the workpiece surface, (b) moving the abrading means, stepwise or continuously, along a particular path with respect to the workpiece surface so as to be capable of selectively abrading the defined surface area and (c), during step (b), either activating the abrading means or deactivating the abrading means according to a prearranged program. The resultant marking is a related sequence of marks, preferably substantially parallel bars of predetermined widths and spacings, abraded into the surface. In a preferred form of the invention, abrasive particles in a gas are conducted at high velocity through a nozzle, whose outlet orifice determines the shape and size of the defined area, and impact on the surface to be marked at selected positions along the particular path.

DETAILED DESCRIPTION

Figure 1:
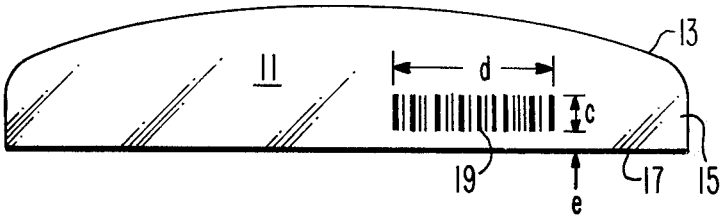
FIG. 1 is an elevational view of one embodiment of the novel workpiece.

FIG. 1 is a typical glass faceplate panel 11 to be used as part of the envelope of a color television picture tube. The panel 11 includes a rectangular viewing window 13 and an integral sidewall 15 around the window 13. the sidewall 15 has a panel seal land 17 at the distal end thereof. A machine-readable coded marking 19 is abraded into the external surface of the sidewall 15. The marking 19 comprises a related sequence of substantially parallel bars of predetermined widths and spacings, which are popularly referred to as a bar-code marking. Any of the codes used for bar-code marking may be used on the panel 11. In this specific embodiment, the marking 19 used the interleaved two-of-five code which employs abraded bars of one-unit and three-unit widths and nonabraded spaces therebetween of one-unit and three-unit widths. Since bar codes are described in detail elsewhere, no further description of the code itself is necessary.

Figure 2:
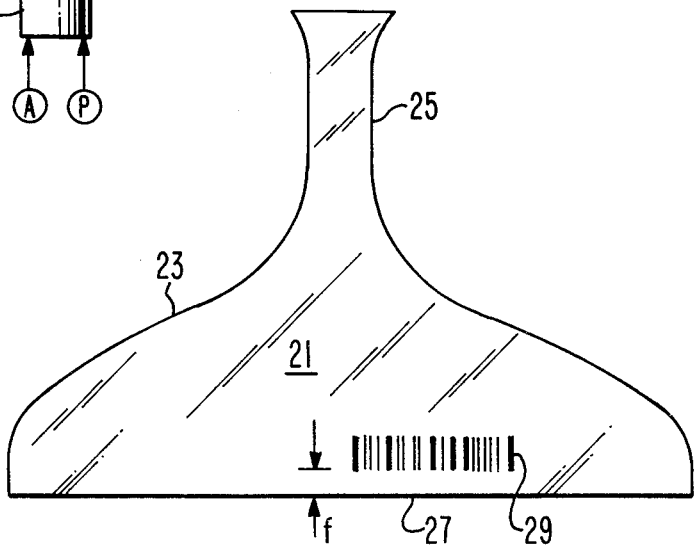
FIG. 2 is an elevational view of another embodiment of the novel workpiece.

FIG. 2 is a typical glass funnel 21 to be used as part of the envelope of a color television picture tube. The funnel includes a cone 23, a neck 25 integral with the narrow end of the cone 23 and a funnel seal land 27 at the wide end of the cone 23. A machine-readable coded marking 29 as described above for the panel 11 is abraded into the external surface of the cone 23 near the wide end of the cone 23.

In both FIGS. 1 and 2, the markings 19 and 29 may be placed anywhere on the workpieces. However, for making and reading the markings automatically by machine, it is important that the markings be placed at locations that are easily located and accessed. As shown in FIG. 1, the panel marking 19 and the marks thereof are a distance c, typically about 19 mm (0.75 inch) high and the marking is a distance d, typically about 63 mm (2.50 inches) wide. The closest edge of the panel marking 19 is a distance e, typically about 19 mm (0.75 inch), away from the seal land 17 with the bars of the marking 19 extending in a direction about normal to the surface of the seal land 17. The abraded marks are either about 0.6 mm (0.025 inch) or about 1.9 mm (0.075 inch) wide. The funnel marking 29 on the funnel 21 shown in FIG. 2 is similar to the above-described panel marking 19 and is located a distance f, typically about 19 mm (0.75 inch), from the funnel seal land 27. During subsequent processing, the panel 11 and the funnel 21 may be joined together at their respective seal lands by methods known in the art. The markings 19 and 29 are not degraded during the common frit-sealing method which employs temperatures of more than 400° C.

The panel 11 (FIG. 1) and the funnel 21 (FIG. 2) are typical glass workpieces included within the invention. Also included within the invention are other workpieces or combinations of workpieces and/or other materials or combinations of materials. For example, many metals such as aluminum, steel, stainless steel, copper, brass, etc. are markable by the novel method. Unlike prior bar-code markings, the markings in the novel article are abraded into the surface of the workpiece. Thus, the marking has substantially the same characteristics to the ambient as the workpiece itself. There is no degradable label, or printing ink or adhesive for a label present which could limit the utility of the marking.

The abraded areas of the marking have a different reflecting characteristic from the adjacent nonabraded surface. In vitreous materials, such as glass, the markings appear as areas of greater reflectivity because the abrasion changes the specular nature of the surface to a more diffuse one. If the geometrical arrangements among the light source, marked surface and detector put the detector off the specular angle, the light scattered into the detector will be increased in the abraded region. In metals, the abraded areas have increased light absorption and therefore appear darker than the nonabraded areas. These markings may be read also by detecting the difference in reflectivity of the surface in the specular angle. It is this difference which allows the marking to be read by a process including optically detecting the reflection from the marked surface. Two devices that may be used to detect these markings are a laser scanner and a TV camera. In the laser scanner, a light beam is scanned across the marked surface whereby the reflected light is modulated by the occurrence of abraded or nonabraded regions. With a TV camera, either ambient light or a fixed light source provides the required illumination to activate the photosensitive surfaces in relation to the abraded or nonabraded areas of the marking.

Abrading is to be distinguished from cutting, incising and engraving, which involve putting sharply-defined grooves in the surface, which grooves weaken the workpiece when it is stressed. Also, abrading is to be distinguished from etching, which requires a chemical reaction which is slow and is difficult to work with. Abrading involves mechanical action principally. Abrasion of selected areas of the surface can be carried out with abrasive particles transported at high velocity in a gas, or a liquid or a solid. Abrading does not cut sharply-defined grooves in the surface and is believed to be superior to other methods for altering a surface of a workpiece in the reliability of the marking and the ease and cost with which it can be produced by machine.

Markings such as are shown at 19 (FIG. 1) and 29 (FIG. 2) can be produced by any suitable abrading process and with any abrading apparatus that can suitably define and locate the marks of the marking. A preformed template or stencil on the surface of the workpiece to define all of the marks of the marking simultaneously, in combination with a means to abrade the exposed surface with a blast of particles may be used, but it is slow, cumbersome and expensive.

Figure 3:
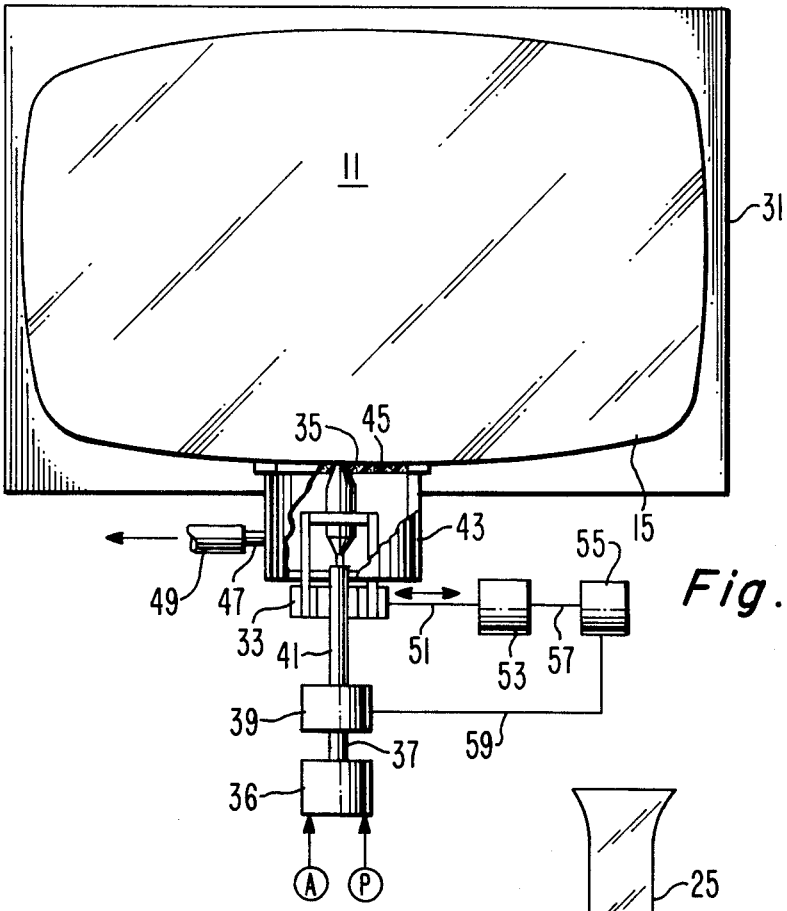
FIG. 3 is a broken-away plan view of an apparatus for practicing the novel method.

FIG. 3 shows an apparatus in which a marking can be made rapidly and cheaply on demand by producing the marks sequentially. The apparatus comprises a workpiece table 31 and a stage 33 which can be moved one with respect to the other. In this embodiment, the table 31 is stationary and the stage 33 is adapted for controlled translational movement with respect to the table. The panel 11 of FIG. 1, but shown from above, is positioned on the table 31 with the seal land 17 against the table surface and the window 13 facing upwardly. A nozzle 35 is mechanically connected to the stage 33 so that the nozzle 35 moves with the stage 33. The output end of the nozzle 35 is closely spaced from the sidewall 15 of the panel 11 in the area of interest for marking.

There is a wide variety of grit sizes and abrasive materials which should be optimized for a given application. Consideration must be given to the hardness of the surface, the time allowed for the process, the wear and tear on the equipment, the amount of material to be removed and the resolution of the desired pattern. For abrading bar codes in glass, it is desirable that the edge roughness of each bar is 0.002 inch or less. This can usually be achieved with particles rated at 27 micron grit. Aluminum oxide, $Al_2O_3$, is preferred because it is capable of quickly abrading glass while producing only moderate wear of the equipment.

The inlet end of the nozzle is a tube or neck supplied with an air-and-abrasive mixture. Air from a source A and abrasive particles from a source P are combined in a mixer 36. The mixture is passed through a first hose 37, then through a control valve 39 capable of turning the stream of air and abrasive off or on, then through a second hose 41 to the input end of the nozzle 35. A dust hood 43 encloses the nozzle 35. The dust hood includes a dust seal 45 adjacent the sidewall 15 and a means 47 for exhausting the inside of the hood 43 to the suction hose 49. The stage 33 is connected by a mechanical linkage 51 to a translator means 53 for moving the stage 33 in a direction that is substantially parallel to the surface of the table 31 and to the sidewall 15. The translator 53 may move the stage stepwise or continuously, as desired. Both the translator 53 and the mixing valve 39 are controlled simultaneously from an electronic controller 55 through electric connections 57 and 59 respectively.

Figure 6:
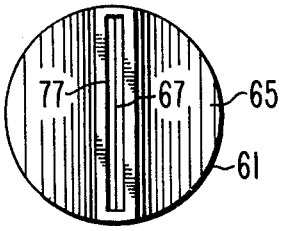
FIGS. 4, 5 and 6 are respectively broken-away front elevational, side elevational and end views of the abrading nozzle shown in FIG. 3.
Figure 4:
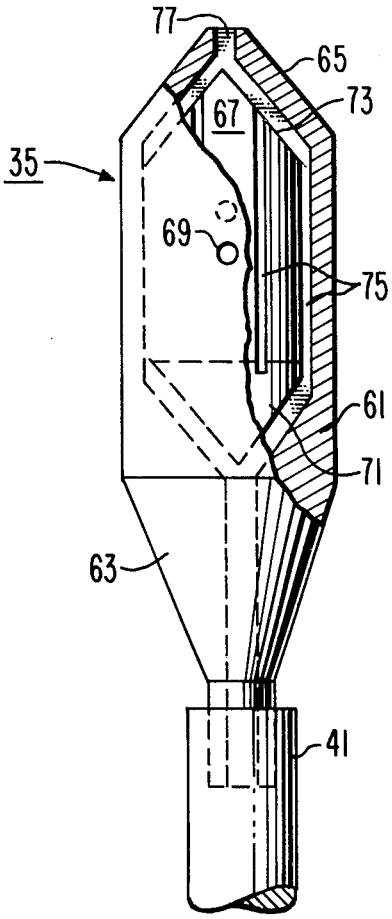
Figure 5:
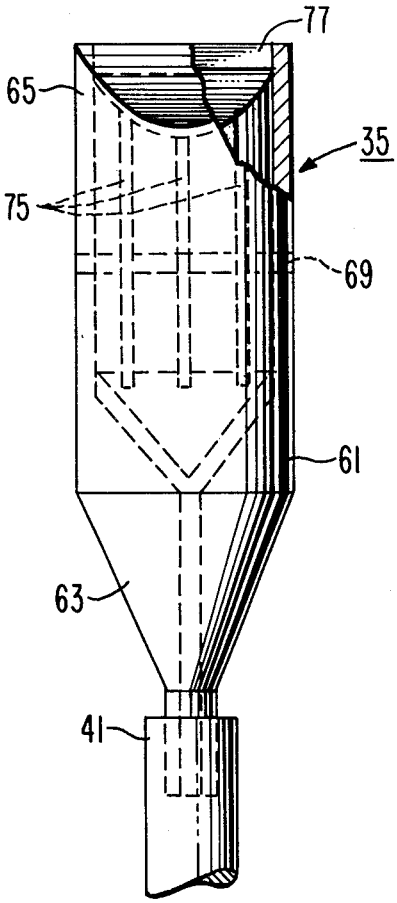

The nozzle 35 is shown enlarged and in greater detail in FIGS. 4, 5 and 6. The nozzle 35 comprises a body 61 which is conical at the inlet end 63 and chisel shaped at the outlet end 65. A core 67, which is held in place by a dowel 69, is located inside. The core 67 is conical at its inlet end 71 and is spaced from the inner wall of the body 61 and chisel shaped at its outlet end 73 and is spaced from the inner wall of the body 61. The core 67 has, between its inlet and outlet ends, straight sides which touch the inner wall of the body 61. There are six grooves 75 about 1.5 mm (60 mils) wide by 1.5 mm (60 mils) deep, in and equally spaced around the core 67. The inner wall of the body 61 and the grooves 75 in the core 67 are so shaped as to provide channels for conducting the air-abrasive mixture around the core 67, converting the circular stream of air and abrasive to a line-shaped stream at the outlet orifice 77. The abrasive particles in the stream are substantially evenly distributed across the outlet orifice 77 of the nozzle. In this embodiment, the outlet orifice 77 is about 19 mm (0.75 inch) high and about 0.5 mm (0.020 inch) wide. An important feature of the nozzle is that its outlet orifice 77 defines the height and width of the narrowest bar to be abraded into the workpiece. With proper manipulation according to the invention, bar-shaped marks can be made serially without the use of a template or stencil for making the marking.

In operation, the outlet orifice 77 of the nozzle is spaced about 0.030 to 0.050 inch from the surface to be marked. The spacing is determined by the trade-off of two requirements. The first requirement is to have enough gap between the nozzle and the workpiece so that the spent air and abrasive can be exhausted without producing significant back pressure at the outlet orifice 77. The second requirement is to have the nozzle close to the work surface so that the emerging stream is not overly widened before impinging upon that surface. Optimal spacing will also depend in part on several parameters including nozzle design, delivery pressure and abrasive flow rate. The nozzle orifice 77 is oriented with its height normal to the surface of the table 31 and positioned at one end of the desired marking area. On command from the controller 55, the stage 33 is advanced stepwise by the translator 53, which moves the nozzle 35 stepwise with respect to the sidewall 15 linearly from one end of the desired marking to the other. Simultaneously, the air-and-abrasive stream is turned on or off as required to produce the desired marking. If the nozzle motion is expressed as units which are equal to the minimum bar width, which is also the minimum space width, then, to obtain bar widths (abraded areas) of one- and three-unit widths, the air-and-abrasive stream is on, that is, the valve 39 is open, for effectively zero- or two-unit widths respectively. To obtain spaces (nonabraded areas) of one- and three-unit widths, then the air-and-abrasive stream is off, that is, the valve 39 is closed, for two- and four-unit widths. In this embodiment, the stage 33 is moved by the translator 53 in steps which are about one fiftieth of a unit width.

By providing automatic workpiece loading and unloading means for the table 31 and an electronically programmed controller 55, markings can be made easily, reliably and cheaply on successive workpieces. To increase the marking rate, n nozzles may be used simultaneously, each nozzle having its own air and abrasive supply and control valve. Each nozzle is independently sprung. The n nozzles translate along the marking width d as a unit, with each nozzle being separated from its nearest neighbor by a distance d/n. Thus, each nozzle-and-control valve assembly is responsible for abrading only 1/n of the entire marking.

The markings may be read with a commercially-available reader at intervals during and after the assembly of the workpiece into an assembled end product. A typical reader is described in U.S. Pat. No. 3,801,182 to P. W. Jones in which a polarized light beam scans across the marking in a direction normal to the length of the bars. The reflected light is sensed and converted to electrical signals representative of the marking, which signals are then decoded and used for some useful purpose, such as the control of a manufacturing process or the compilation of historical data.

I claim:

1. A method for producing a machine-readable coded marking in a surface of a rigid workpiece, said marking comprising a related sequence of substantially parallel bars of at least two different widths separated by substantially parallel spacings comprising (a) providing means for abrading a single defined strip-like area of said surface, said defined area having about the width of the smaller of said two different widths of said bars, (b) moving said abrading means along a particular substantially linear path with respect to said surface in the direction of the width of said defined area so as to selectively target a succession of contiguous defined areas of said surface, (c) and, during step (b), either activating said abrading means to abrade at one time the entire targetted defined area of said surface or deactivating said abrading means to not abrade any part of said targetted defined surface area according to a prearranged program.

2. The method defined in claim 1 wherein said abrading means includes a nozzle, means for transporting abrasive particles in a gas through said nozzle and to impact on said surface, and means for permitting or preventing said transporting of abrasive particles through said nozzle at selected positions along said path, said defined area being determined by the shape of the outlet orifice in said nozzle.

3. The method defined in claim 2 wherein said marking is a related sequence of substantially parallel bars of predetermined widths and spacings and said outlet orifice defines the width of the narrowest of said parallel bars and, in step (b), moving said abrading means along a path substantially parallel to the widths of said bars.

4. A method for producing a machine-readable coded marking in a surface of a rigid workpiece, said marking comprising a related sequence of substantially parallel bars of at least two different widths separated by substantially parallel spacings, said method comprising (a) sequentially targetting a series of contiguous, substantially parallel strip-like areas of unit widths on said surface, said series of areas being located along a linear path in the direction of the widths of said areas, and (b) removing at one time all of the surface portions of each of selected ones of said targetted areas according to a prearranged program related to said marking, some of said selected areas being contiguous.

5. The method defined in claim 4 wherein said surface portions are removed by abrasion.

* * * * *